US007339468B2

(12) United States Patent
Andres et al.

(10) Patent No.: US 7,339,468 B2
(45) Date of Patent: Mar. 4, 2008

(54) RADIO FREQUENCY COMMUNICATIONS SCHEME IN LIFE SAFETY DEVICES

(75) Inventors: John J. Andres, Chapel Hill, NC (US); Matthew J. Buchholz, Canon City, CO (US); Stan Burnette, Colorado Springs, CO (US); Travis Silver, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 14 days.

(21) Appl. No.: 11/253,289

(22) Filed: Oct. 17, 2005

(65) Prior Publication Data

US 2006/0082455 A1 Apr. 20, 2006

Related U.S. Application Data

(60) Provisional application No. 60/623,978, filed on Nov. 1, 2004, provisional application No. 60/620,227, filed on Oct. 18, 2004.

(51) Int. Cl.
*G08B 1/08* (2006.01)

(52) U.S. Cl. ..... 340/539.1; 340/573.1; 340/628; 455/404.1

(58) Field of Classification Search ..... 340/539.1
See application file for complete search history.

(56) References Cited

U.S. PATENT DOCUMENTS 2,249,560 A 7/1941 Howton
2,566,121 A 8/1951 Decker
3,559,194 A 1/1971 Bisberg
3,909,826 A 9/1975 Schildmeier et al.
3,932,850 A 1/1976 Conforti et al.
4,020,479 A 4/1977 Conforti et al.

(Continued)

FOREIGN PATENT DOCUMENTS

JP 2-121093 5/1990

(Continued)

OTHER PUBLICATIONS

Invensys Climate ControlsInvensys Launch Firex® 7000 Combination Smoke and Carbon Monoxide Alarm, 2 pages (Oct. 16, 2003).

(Continued)

*Primary Examiner*—George Bugg
(74) *Attorney, Agent, or Firm*—Merchant & Gould P.C.

(57) ABSTRACT

A method of radio frequency communication for a life safety device including a controller, a hazardous condition sensor, an alarm device, and a radio frequency communications device including transmitting and receiving capability. One method includes receiving a test signal using the radio frequency communications device, lowering a voltage to the hazardous condition sensor to simulate a hazardous condition to test the hazardous condition sensor, and emitting an alarm using the alarm device if the hazardous condition sensor passes the test. Another method includes before transmitting a radio frequency signal, turning on the radio frequency communications device for a period of time, and delaying transmission if the radio frequency communications device receives a header, deadtime and startbit. Yet another method includes sending a test signal at a first transmission power level, and sending an alarm signal at a second transmission power level greater than the first transmission power level.

13 Claims, 7 Drawing Sheets

U.S. PATENT DOCUMENTS

| | | | |
|---|---|---|---|
| 4,091,363 A | 5/1978 | Siegel et al. | |
| 4,097,851 A | 6/1978 | Klein | |
| 4,112,310 A | 9/1978 | Malinowski | |
| 4,138,664 A | 2/1979 | Conforti et al. | |
| 4,138,670 A | 2/1979 | Schneider et al. | |
| 4,139,846 A | 2/1979 | Conforti | |
| 4,160,246 A | 7/1979 | Martin et al. | |
| 4,178,592 A | 12/1979 | McKee | |
| 4,189,720 A | 2/1980 | Lott | |
| 4,204,201 A | 5/1980 | Williams et al. | |
| 4,225,860 A | 9/1980 | Conforti | |
| 4,232,308 A | 11/1980 | Lee et al. | |
| 4,258,261 A | 3/1981 | Conforti | |
| 4,284,849 A | 8/1981 | Anderson et al. | |
| 4,287,517 A | 9/1981 | Nagel | |
| 4,302,753 A | 11/1981 | Conforti | |
| 4,363,031 A | 12/1982 | Reinowitz | |
| 4,517,555 A | 5/1985 | Marsocci et al. | |
| 4,531,114 A | 7/1985 | Topol et al. | |
| 4,556,873 A | 12/1985 | Yamada et al. | |
| 4,581,606 A | 4/1986 | Mallory | |
| 4,583,072 A | 4/1986 | Matsushita | |
| 4,594,581 A | 6/1986 | Matoba | |
| 4,647,219 A | 3/1987 | Figler et al. | |
| 4,692,750 A | 9/1987 | Murakami et al. | |
| 4,737,770 A | 4/1988 | Brunius et al. | |
| 4,772,876 A | 9/1988 | Laud | |
| 4,788,530 A | 11/1988 | Bernier | |
| 4,801,924 A | 1/1989 | Burgmann et al. | |
| 4,814,748 A | 3/1989 | Todd | |
| 4,827,244 A | 5/1989 | Bellavia et al. | |
| 4,829,283 A | 5/1989 | Spang et al. | |
| 4,845,474 A | 7/1989 | Moore et al. | |
| 4,855,713 A | 8/1989 | Brunius | |
| 4,859,990 A | 8/1989 | Isaacman | |
| 4,870,395 A | 9/1989 | Belano | |
| 4,884,065 A | 11/1989 | Crouse et al. | |
| 4,901,056 A | 2/1990 | Bellavia et al. | |
| 4,904,988 A | 2/1990 | Nesbit et al. | |
| 4,951,029 A | 8/1990 | Severson | |
| 4,965,556 A | 10/1990 | Brodecki et al. | |
| 4,992,965 A | 2/1991 | Hölter et al. | |
| 5,034,725 A | 7/1991 | Sorensen | |
| 5,063,164 A | 11/1991 | Goldstein | |
| 5,066,466 A | 11/1991 | Hölter et al. | |
| 5,077,547 A | 12/1991 | Burgmann | |
| 5,095,300 A | 3/1992 | Alexander et al. | |
| 5,103,216 A | 4/1992 | Sisselman | |
| RE33,920 E | 5/1992 | Tanguay et al. | |
| 5,122,782 A | 6/1992 | Kawahara | |
| 5,132,958 A | 7/1992 | Camps et al. | |
| 5,132,968 A | 7/1992 | Cephus | |
| 5,159,315 A | 10/1992 | Schultz et al. | |
| 5,172,096 A | 12/1992 | Tice et al. | |
| 5,177,461 A | 1/1993 | Budzyna et al. | |
| 5,252,949 A | 10/1993 | Kirby et al. | |
| 5,280,273 A | 1/1994 | Goldstein | |
| 5,285,792 A | 2/1994 | Sjoquist et al. | |
| 5,289,165 A | 2/1994 | Belin | |
| 5,317,305 A | 5/1994 | Campman | |
| 5,386,209 A | 1/1995 | Thomas | |
| 5,408,217 A | 4/1995 | Sanderford, Jr. | |
| 5,422,629 A | 6/1995 | Minnis | |
| 5,440,293 A | 8/1995 | Tice | |
| 5,442,336 A | 8/1995 | Murphy et al. | |
| 5,444,434 A | 8/1995 | Serby | |
| 5,473,167 A | 12/1995 | Minnis | |
| 5,481,259 A | 1/1996 | Bane | |
| 5,483,222 A | 1/1996 | Tice | |
| 5,500,639 A | 3/1996 | Walley et al. | |
| 5,517,182 A | 5/1996 | Yasunaga | |
| 5,574,436 A | 11/1996 | Sisselman et al. | |
| 5,578,996 A | 11/1996 | Watson et al. | |
| 5,587,705 A | 12/1996 | Morris | |
| 5,594,410 A | 1/1997 | Lucas et al. | |
| 5,594,422 A | 1/1997 | Huey, Jr. et al. | |
| 5,621,394 A | 4/1997 | Garrick et al. | |
| 5,663,714 A | 9/1997 | Fray | |
| 5,666,331 A | 9/1997 | Kollin | |
| 5,682,145 A | 10/1997 | Sweetman et al. | |
| 5,686,885 A | 11/1997 | Bergman | |
| 5,686,896 A | 11/1997 | Bergman | |
| 5,694,118 A | 12/1997 | Park et al. | |
| 5,705,979 A | 1/1998 | Fierro et al. | |
| 5,748,079 A | 5/1998 | Addy | |
| 5,764,150 A | 6/1998 | Fleury et al. | |
| 5,774,038 A | 6/1998 | Welch et al. | |
| 5,781,143 A | 7/1998 | Rossin | |
| 5,786,768 A | 7/1998 | Chan et al. | |
| 5,793,296 A | 8/1998 | Lewkowicz | |
| 5,801,633 A | 9/1998 | Soni | |
| 5,808,551 A | 9/1998 | Yarnall, Jr. et al. | |
| 5,812,617 A | 9/1998 | Heckman et al. | |
| 5,815,066 A | 9/1998 | Pumilia | |
| 5,815,075 A | 9/1998 | Lewiner et al. | |
| 5,818,334 A | 10/1998 | Stanley | |
| 5,831,526 A | 11/1998 | Hansler et al. | |
| 5,848,062 A | 12/1998 | Ohno | |
| 5,857,146 A | 1/1999 | Kido | |
| 5,867,105 A | 2/1999 | Hajel | |
| 5,889,468 A | 3/1999 | Banga | |
| 5,898,369 A | 4/1999 | Goodwin | |
| 5,905,438 A | 5/1999 | Weiss et al. | |
| 5,907,279 A | 5/1999 | Bruins et al. | |
| 5,914,656 A | 6/1999 | Ojala et al. | |
| 5,933,078 A * | 8/1999 | O'Donnell | 340/506 |
| 5,949,332 A | 9/1999 | Kim | |
| 5,969,600 A | 10/1999 | Tanguay | |
| 5,977,871 A | 11/1999 | Miller et al. | |
| 6,028,513 A | 2/2000 | Addy | |
| 6,044,359 A | 3/2000 | Goodwin, III | |
| 6,049,273 A | 4/2000 | Hess | |
| 6,054,920 A | 4/2000 | Smith et al. | |
| 6,078,269 A | 6/2000 | Markwell et al. | |
| 6,081,197 A | 6/2000 | Garrick et al. | |
| 6,084,522 A | 7/2000 | Addy | |
| 6,111,872 A | 8/2000 | Suematsu et al. | |
| 6,114,955 A | 9/2000 | Brunius et al. | |
| 6,121,874 A * | 9/2000 | O'Donnell | 340/506 |
| 6,133,839 A | 10/2000 | Ellul, Jr. et al. | |
| 6,144,289 A | 11/2000 | Le Bel | |
| 6,144,310 A | 11/2000 | Morris | |
| 6,150,936 A | 11/2000 | Addy | |
| 6,172,612 B1 | 1/2001 | Odachowski | |
| 6,188,715 B1 | 2/2001 | Partyka | |
| 6,208,253 B1 | 3/2001 | Fletcher et al. | |
| 6,229,449 B1 | 5/2001 | Kirchner et al. | |
| 6,243,010 B1 | 6/2001 | Addy et al. | |
| 6,292,108 B1 | 9/2001 | Straser et al. | |
| 6,301,514 B1 | 10/2001 | Canada et al. | |
| 6,307,482 B1 | 10/2001 | Le Bel | |
| 6,323,780 B1 | 11/2001 | Morris | |
| 6,353,395 B1 | 3/2002 | Duran | |
| 6,380,860 B1 | 4/2002 | Goetz | |
| 6,384,724 B1 | 5/2002 | Landais | |
| 6,414,599 B1 | 7/2002 | Hsieh | |
| 6,420,973 B2 | 7/2002 | Acevedo | |
| 6,441,723 B1 | 8/2002 | Mansfield, Jr. et al. | |
| 6,445,291 B2 | 9/2002 | Addy et al. | |
| 6,445,292 B1 | 9/2002 | Jen et al. | |
| 6,492,907 B1 | 12/2002 | McCracken | |
| 6,529,128 B2 | 3/2003 | Weng | |
| 6,577,239 B2 | 6/2003 | Jespersen | 340/572.1 |
| 6,577,242 B2 | 6/2003 | Jen et al. | |

| | | | |
|---|---|---|---|
| 6,600,424 | B1 | 7/2003 | Morris |
| 6,611,204 | B2 | 8/2003 | Schmurr |
| 6,624,750 | B1 | 9/2003 | Marman et al. |
| 6,624,760 | B1 | 9/2003 | Kinzel et al. |
| 6,642,849 | B1 | 11/2003 | Kondziolka |
| 6,693,532 | B2 | 2/2004 | Capowski et al. |
| 6,762,688 | B2 | 7/2004 | Johnston et al. |
| 6,791,453 | B1 | 9/2004 | Andres et al. |
| 7,034,703 | B2 * | 4/2006 | Morris ..... 340/628 |
| 2001/0024163 | A1 | 9/2001 | Petite |
| 2001/0038336 | A1 | 11/2001 | Acevedo |
| 2001/0038337 | A1 | 11/2001 | Wickstead et al. |
| 2001/0043144 | A1 | 11/2001 | Morris |
| 2002/0021223 | A1 | 2/2002 | Jen et al. |
| 2002/0047774 | A1 | 4/2002 | Christensen et al. |
| 2002/0080039 | A1 | 6/2002 | Vining |
| 2002/0093430 | A1 | 7/2002 | Goodwin |
| 2002/0093439 | A1 | 7/2002 | Lundin et al. |
| 2002/0126016 | A1 | 9/2002 | Sipp |
| 2002/0130782 | A1 | 9/2002 | Johnston et al. |
| 2002/0145513 | A1 | 10/2002 | Ropke |
| 2002/0158764 | A1 | 10/2002 | Conway |
| 2002/0163428 | A1 | 11/2002 | Weng |
| 2002/0175811 | A1 | 11/2002 | Merrell et al. |
| 2003/0031140 | A1 | 2/2003 | Oprescu-Surcobe et al. |
| 2003/0052770 | A1 | 3/2003 | Mansfield, Jr. et al. |
| 2003/0058114 | A1 | 3/2003 | Miller et al. |
| 2003/0080865 | A1 | 5/2003 | Capowski et al. |
| 2003/0090375 | A1 | 5/2003 | Addy et al. |
| 2003/0179096 | A1 | 9/2003 | Hanan |
| 2003/0210138 | A1 | 11/2003 | Farley |
| 2003/0227387 | A1 | 12/2003 | Kimberlain et al. |
| 2003/0230415 | A1 | 12/2003 | Wilson et al. |

FOREIGN PATENT DOCUMENTS

| | | |
|---|---|---|
| JP | 3-30096 | 2/1991 |
| JP | 3-240198 | 10/1991 |
| JP | 3-276393 | 12/1991 |
| JP | 4-10194 | 1/1992 |
| JP | 4-57197 A | 2/1992 |
| JP | 5-210790 | 8/1993 |
| JP | 7-6283 | 1/1995 |
| JP | 7-65268 | 3/1995 |
| JP | 8-751 | 1/1996 |
| JP | 10-11680 | 1/1998 |
| JP | 11-86160 | 3/1999 |
| JP | 2002-216261 | 8/2002 |
| JP | 2002-216262 | 8/2002 |
| WO | WO 92/10820 | 6/1992 |
| WO | WO 94/03881 | 2/1994 |
| WO | WO 02/084620 A1 | 10/2002 |

OTHER PUBLICATIONS

AICO, Radiolink, 6 pages (Sep. 23, 2004).
International Search Report mailed Feb. 21, 2007.

* cited by examiner

RADIO FREQUENCY COMMUNICATIONS SCHEME IN LIFE SAFETY DEVICES

RELATED APPLICATIONS

This application claims the benefit of U.S. Patent Provisional Application Ser. No. 60/620,227 filed on Oct. 18, 2004, and U.S. Patent Provisional Application Ser. No. 60/623,978 filed on Nov. 1, 2004, the entireties of which are hereby incorporated by reference.

TECHNICAL FIELD

The disclosed technology relates to a networked system of compatible life safety devices. More particularly, the disclosed technology relates to a radio frequency communications scheme that facilitates radio frequency communications between compatible components of a system of life safety devices.

BACKGROUND

It is known to use life safety devices within a building or other structure to detect various hazardous conditions and/or provide a warning to occupants of the building of the detected hazardous condition. Examples of well known life safety devices include smoke detectors and carbon monoxide detectors. Some life safety devices include both the capability to detect a hazardous condition, for example smoke, and to generate an audible and/or visual alarm to provide an alert that a hazardous condition has been detected. Other life safety devices are configured to detect a hazardous condition, and when a hazardous condition is detected, send a signal to a remote life safety device, for example an alarm device, which generates the alarm. In each case, a hazardous condition is detected and an alarm generated warning of the hazardous condition.

In a building with multiple rooms or levels equipped with conventional life safety devices, the occupants of the building may not be adequately or timely warned of a hazardous condition that has been detected in a part of the building not presently occupied by the occupant. Attempts to remedy this problem include the use of detectors that communicate with one another via radio frequency (RF) signals in which the detector that detects a hazardous condition sends an RF signal to other detectors in the building thereby triggering a warning on those detectors (see, e.g., U.S. Pat. Nos. 5,587,705 and 5,898,369), and detectors that are hardwired interconnected to one another and/or to one or more monitoring or signaling units (see, e.g., U.S. Pat. No. 6,353,395).

The use of RF interconnected life safety devices is attractive as an existing building, for example a home, can be equipped with the safety devices without the need to run new wiring throughout the building. RF interconnected life safety devices are also beneficial because many buildings have high ceilings on which the safety devices are most suitably placed for optimum detection. This can make it difficult to physically access the safety devices, which has been previously necessary to conduct the recommended periodic testing of each safety device and to silence the safety device after it has started signaling an alarm. Examples of using RF signals to communicate between life safety devices during testing are disclosed in U.S. Pat. Nos. 4,363,031 and 5,815,066.

Despite the existence of life safety devices using RF communications, there is a need for improvements in RF communications between RF configured life safety devices.

SUMMARY

The disclosed technology relates to a networked system of compatible life safety devices. More particularly, the disclosed technology relates to a radio frequency communications scheme that facilitates radio frequency communications between compatible components of a system of life safety devices.

According to one aspect, a method of radio frequency communication for a life safety device including a controller, a hazardous condition sensor, an alarm device, and a radio frequency communications device including transmitting and receiving capability, includes: receiving a test signal using the radio frequency communications device; lowering a voltage to the hazardous condition sensor to simulate a hazardous condition to test the hazardous condition sensor; and emitting an alarm using the alarm device if the hazardous condition sensor passes the test.

According to another aspect, a method of radio frequency communication for a life safety device including a controller, a hazardous condition sensor, an alarm, and a radio frequency communications device including transmitting and receiving capability, includes: before transmitting a radio frequency signal, turning on the radio frequency communications device for a period of time; and delaying transmission if the radio frequency communications device receives a header, deadtime and startbit.

According to yet another aspect, a method of radio frequency communication for a life safety device including a controller, a hazardous condition sensor, an alarm, and a radio frequency communications device including transmitting and receiving capability, includes: sending a test signal at a first transmission power level; and sending an alarm signal at a second transmission power level greater than the first transmission power level.

DETAILED DESCRIPTION

Figure 1:
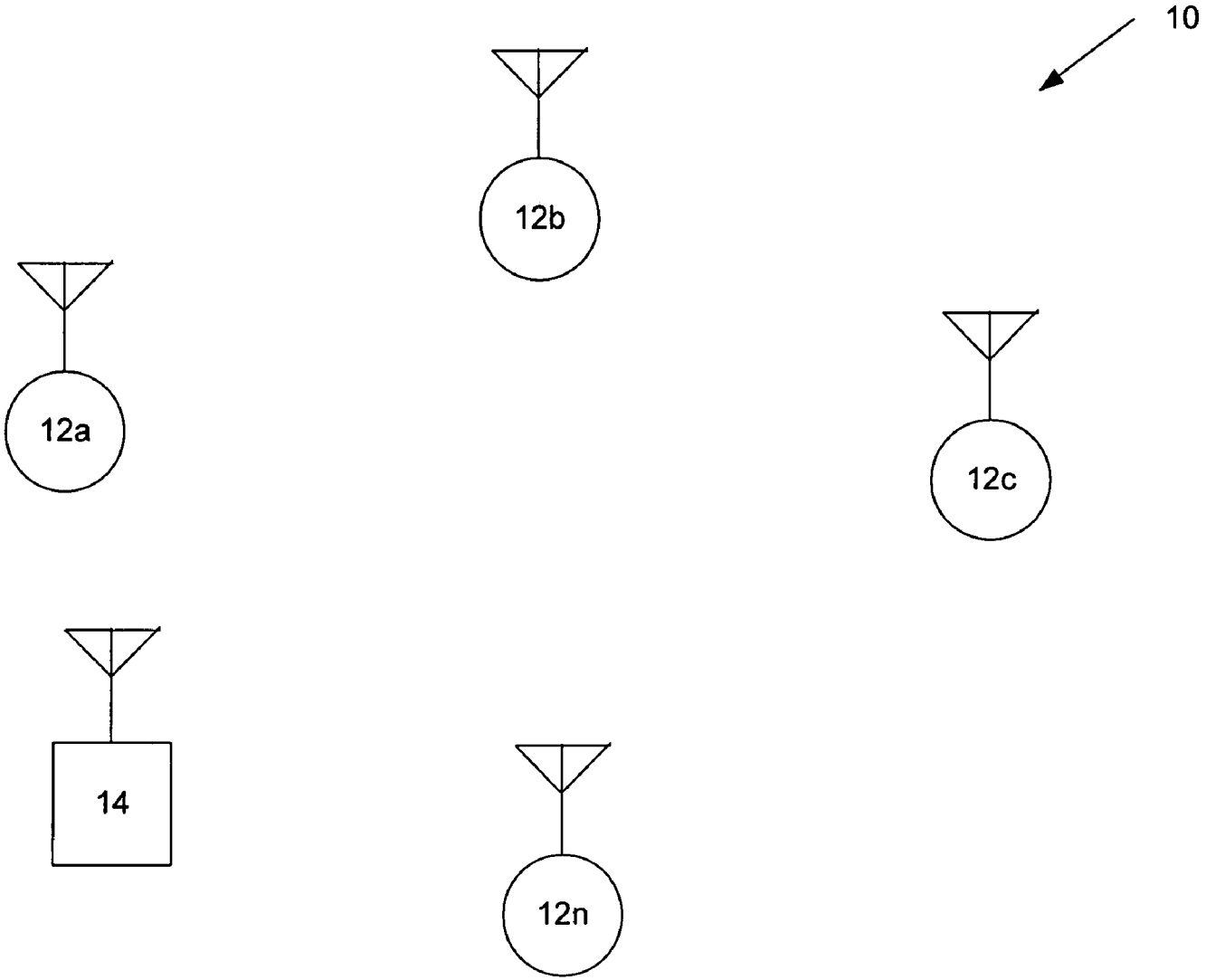
FIG. 1 illustrates an example of a system of life safety devices.

An example of a system 10 of life safety devices is illustrated in FIG. 1. The illustrated system 10 is composed of a plurality of hazardous condition detectors 12*a*, 12*b*, 12*c*, . . . 12*n*, and at least one non-detecting device 14. It is to be realized that the system 10 can be composed of hazardous condition detectors without a non-detecting device, or with more than one non-detecting device. In one embodiment, a plurality of the hazardous condition detectors can be sold along with one of the non-detecting device in a life safety kit.

The hazardous condition detectors are distributed at suitable locations within a building for detecting hazardous conditions throughout the building. For example, if the building is a home, the detectors can be located in the various rooms of the home, including the kitchen, the basement, the bedrooms, etc. The non-detecting device 14, if included in the system 10, can be located at any convenient location within the home, for example in each room in which a detector is located, or at a central location of the home found to be convenient by the homeowner.

The hazardous condition detectors 12*a*, 12*b*, 12*c*, . . . 12*n* include, but are not limited to, environmental condition detectors for detecting hazardous environmental conditions, such as smoke detectors, gas detectors for detecting carbon monoxide gas, natural gas, propane, and other toxic gas, fire detectors, flame detectors, heat detectors, infra-red sensors, ultra-violet sensors, and combinations thereof. The hazardous condition detectors can also include, but are not limited to, detectors that detect a non-environmental hazardous condition, for example glass breakage sensors and motion sensors. For sake of convenience, the hazardous condition detectors 12*a-n* will hereinafter be described and referred to as smoke detectors 12 that are configured to detect smoke. However, it is to be realized that the detectors can include other forms of detectors as well.

The smoke detectors 12 are also preferably configured to be able to produce an alarm when smoke is detected or for testing of the detectors 12. The alarm produced by each detector can be an audible alarm, a visual alarm, or a combination thereof. If an audible alarm is used, the audible alarm can be a tonal alarm, a verbal alarm, or a combination of both. An example of the use of a tonal alarm in combination with a verbal alarm is disclosed in U.S. Pat. No. 6,522,248. If a verbal alarm is used, the verbal alarm can result from pre-recorded voice messages, synthesized voice messages, and/or user recorded voice messages.

The smoke detectors 12 can be DC powered by one or more batteries, or AC powered with battery backup. For sake of convenience, the smoke detectors 12 will be hereinafter described as producing an audible alarm and being DC powered by one or more batteries.

The non-detecting device 14 is not configured to detect a hazardous condition. Instead, the non-detecting device 14 is intended to interact with the smoke detectors 12 to initiate actions in the detectors 12 and to signal an alarm when a suitable signal is received from a detector 12.

The non-detecting device(s) 14 is configured to initiate actions in the smoke detectors 12, for example initiating a test of the smoke detectors or silencing the smoke detectors. In addition, the non-detecting device(s) 14 is configured to monitor the smoke detectors 12 and signal an alarm when one of the detectors 12 detects smoke or when a test signal is received from a detector 12. The non-detecting device(s) 14 includes, but is not limited to, a sound module for producing an audible alarm, a light unit that is configured to illuminate a light as a warning, a control unit that is configured to store and/or display data received from or relating to other life safety devices in the system, and combinations thereof.

For sake of convenience, the non-detecting device(s) 14 will hereinafter be referred to as a sound module 14 that is configured to produce an audible alarm and initiate actions in the detectors 12 of the system 10. The non-detecting device(s) 14 is preferably AC powered with battery backup.

Figure 2:
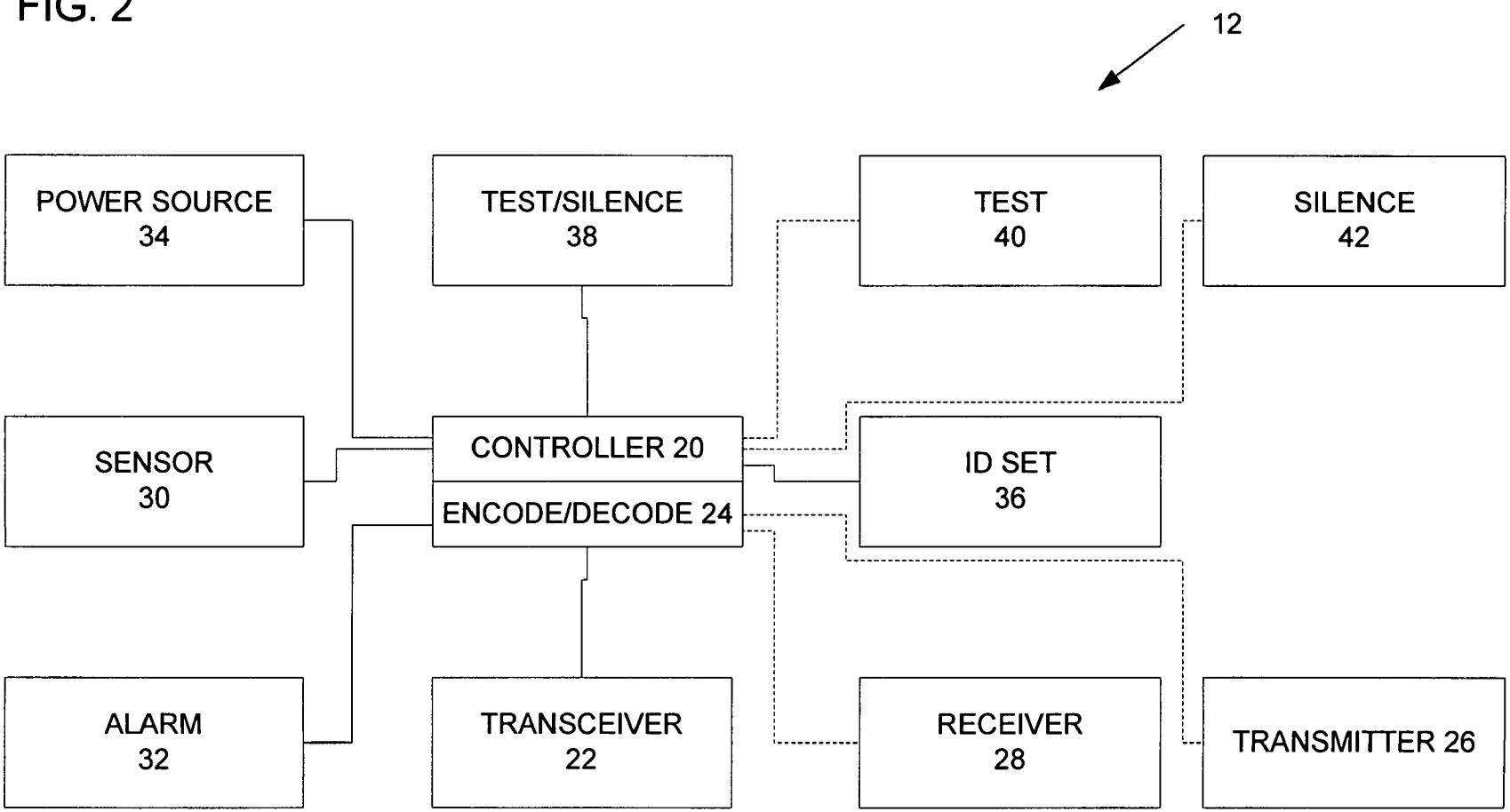
FIG. 2 is a block diagram of a hazardous condition detector that can form one of the life safety devices of the system of FIG. 1.

Details of a smoke detector 12 are illustrated in FIG. 2. The smoke detector 12 comprises a controller 20, which is preferably a microprocessor. The controller 20 is responsible for all RF-related communication tasks, including sending and receiving signals, and coding and decoding the signals.

To send and receive RF signals, the detector 12 includes an RF communications device 22, for example an RF transceiver, that receives coded RF signals from other devices in the system 10, for example from another detector 12 or from the sound module 14, and that transmits coded RF signals to the other detectors 12 and the sound module 14 of the system 10. The coding and decoding of the received and transmitted signals is performed by suitable coding/decoding firmware 24 built into the controller 20. The RF signals are preferably amplitude modulated signals. However, other signal modulation techniques could be used as well. The RF communications device 22 will hereinafter be described as an RF transceiver, although it is to be realized that other forms of RF communications devices could be used as well. For example, in an alternative embodiment, a separate transmitter 26 and receiver 28 illustrated in dashed lines in FIG. 2 can be used in place of the transceiver 22.

A suitable smoke sensor 30 (or other sensor, for example CO sensor, flame sensor, fire sensor, etc. depending upon the type of detector) is connected to the controller 20 for detecting smoke and providing a signal relating to the level of smoke detected. The sensor 30 can be an ionization smoke sensor or a photoelectric smoke sensor of a type known in the art. Upon a sufficient level of smoke being sensed by sensor 30, the controller 20 sends a signal to an alarm circuit 32 to trigger an audible alarm, for example an interleaved tonal alarm and a voice message. Power for the controller 20, the sensor 30, the alarm 32 and the other components of the detector 12 is provided by a battery power source 34.

An identification circuit 36 is provided for setting a unique ID of the detector that corresponds to the ID of other devices in the system 10. For example, the circuit 36 can comprise an eight-position DIP switch that is user configurable to allow the user to set the ID of each detector to a common ID. Other forms of identification circuitry can be used instead of DIP switches, or the firmware of the controller can be used to create the ID. All detectors and other devices in the system 10 must have the same ID in order to communicate with one another. This prevents systems in adjacent buildings or apartments from communicating with each other.

In addition, a test/silence button 38 is provided on the detector 12. The button 38, when pressed, allows a user to initiate a test of the detector 12 to trigger an alarm on the alarm circuit 32. The detector 12 will also send an RF test message via the transceiver 22 to remote devices in the system 10 to initiate a test of the remote devices in the system. The button 38, when pressed, also allows a user to silence a local alarm, and send an RF silence message via the transceiver 22 to remote devices in the system 10 to silence the remote devices in the system. If the detector 12 is in alarm when the button 38 is pressed, the silence message will be sent to the remote devices. If the detector 12 is not in alarm when the button 38 is pressed, the detector will send the RF test message. The test and silence messages preferably continue for up to ten seconds after the user releases the button. In an alternative configuration, illustrated in dashed lines in FIG. 2, separate test 40 and silence 42 buttons can be used instead of the single button 38.

Figure 3:
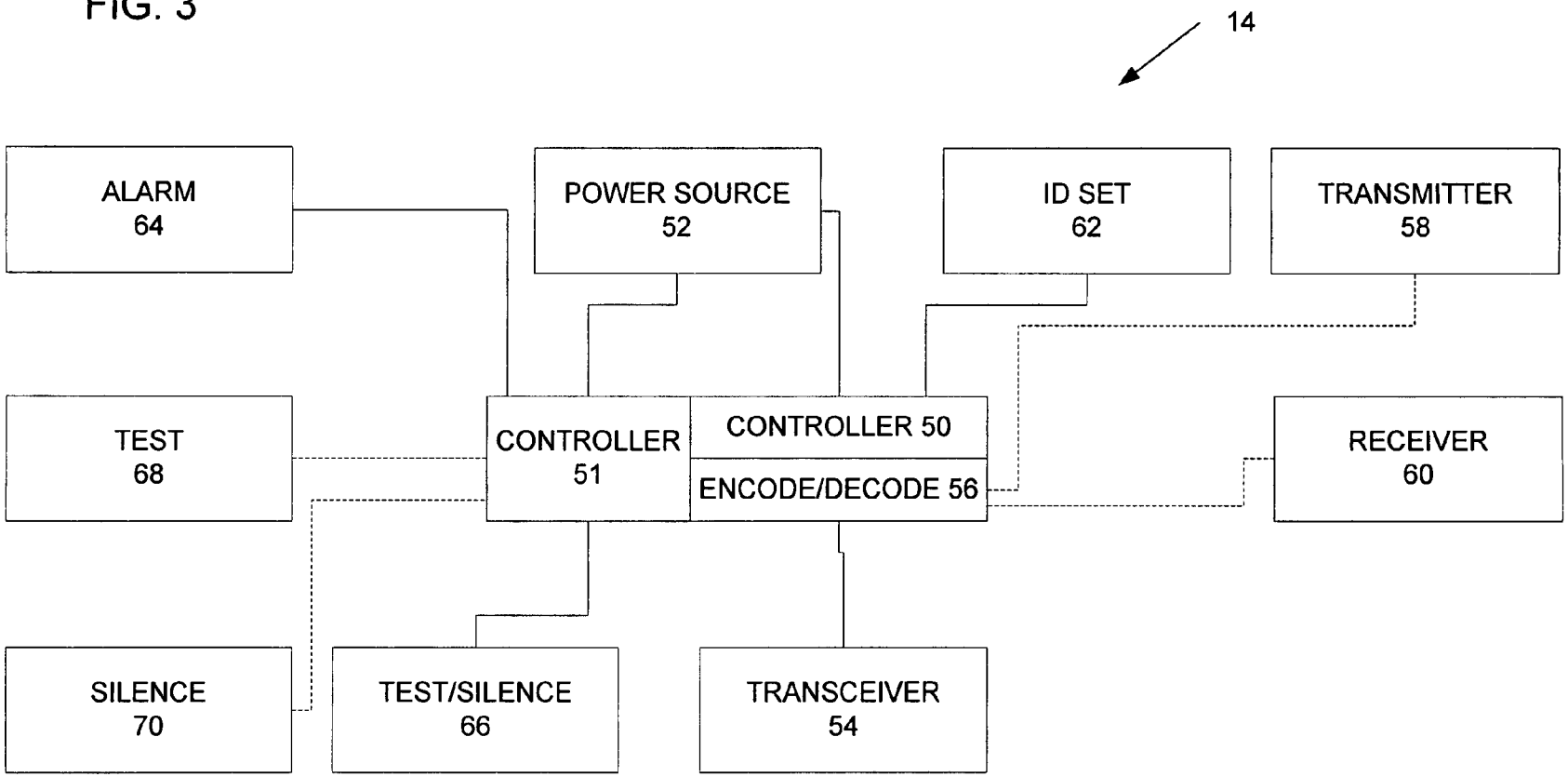
FIG. 3 is a block diagram of a sound module that can form one of the life safety devices of the system of FIG. 1.

Turning now to FIG. 3, the details of the sound module 14 will now be described. The sound module 14 comprises a first controller 50, preferably a microprocessor, for controlling the RF communication functions of the sound module, and a second controller 51, preferably a microprocessor, for controlling all remaining functions of the sound module. If desired, a single controller could be used in place of two controllers to control operations of the sound module. The controllers 50, 51 and the other components of the sound module 14 are preferably powered by an AC power source 52, such as mains electrical power. In the preferred embodiment, the sound module 14 is configured to plug into an electrical outlet near where it is placed. The sound module 14 also preferably includes one or more batteries as a back-up power source.

The sound module 14 also includes an RF communications device 54, for example an RF transceiver 54, that receives coded RF signals from other devices in the system 10, for example from a detector 12, and that transmits coded RF signals to the detectors 12 of the system 10. The coding and decoding of the received and transmitted signals is performed by suitable coding/decoding firmware 56 built into the controller 50. As with the detectors, the RF signals sent by the sound module 14 are preferably amplitude modulated. The RF communications device 54 will hereinafter be described as an RF transceiver, although it is to be realized that other forms of RF communications devices could be used as well. For example, in an alternative embodiment, a separate transmitter 58 and receiver 60 illustrated in dashed lines in FIG. 3 can be used in place of the transceiver 54.

An identification circuit 62 is provided for setting a unique ID of the sound module 14, corresponding to the ID of the detectors 12. As with the detectors 12, the circuit 62 of the sound module 14 can comprise an eight-position DIP switch that is user configurable to allow the user to set the ID of the sound module to match the ID set in the detectors 12. Other forms of identification circuitry can be used instead of DIP switches, or the firmware of either one of the controllers 50, 51 can be used to create the ID.

The sound module 14 also includes an alarm circuit 64 that is triggered when the transceiver 54 receives an alarm signal or a test signal from a remote detector 12. As with the alarm circuit 32, the alarm circuit 64 triggers an audible alarm, for example an interleaved tonal alarm and a voice message.

In addition, a test/silence button 66 is provided on the sound module 14. The button 66, when pressed, allows a user to initiate a test of the sound module 14 to trigger the alarm circuit 64. The sound module 14 will also send an RF test message via the transceiver 54 to the detectors 12 in the system 10 to initiate a test of the detectors 12. The button 66, when pressed, also allows a user to silence the alarm 64, and send an RF silence message via the transceiver 54 to the detectors 12 to silence the detectors 12. If the sound module 14 is in alarm when the button 66 is pressed, the silence message will be sent to the detectors 12. If the sound module 14 is not in alarm when the button 66 is pressed, the sound module will send the RF test message. The test and silence messages preferably continue for up to ten seconds after the user releases the button. In an alternative configuration, illustrated in dashed lines in FIG. 3, separate test 68 and silence 70 buttons can be used instead of the single button 66.

Overview of System Operation

A user installs the smoke detectors 12 at appropriate locations and locates one or more sound modules 14 as desired. After setting the code of the detectors 12 and sound module(s) 14 to a common ID, the system is ready to operate. A detector 12 is capable of detecting local smoke and sounding its alarm, and triggering the alarms of other detectors 12 and of the sound module when smoke is detected. Testing of the system can also be initiated by pushing a button on one of the detectors, or on the sound module, thereby initiating the local alarm and sending an alarm test signal to the other devices to trigger the alarms on remote devices. The alarms of the system can also be silenced by pushing a button on one of the detectors, or on the sound module, thereby silencing the local alarm and sending a silence signal to the other devices to silence the alarms on remote devices. When a detector 12 receives a message from another detector or from a sound module, and when a sound module receives a message from another sound module or from a detector, the detector or sound module will take appropriate action based on the contents of the received message.

In the case of a smoke condition, if a smoke detector 12 detects a sufficient level of smoke, the detector 12 detecting the smoke will sound its alarm and initiate a series of RF transmissions to the other detectors 12 and to the sound module(s) 14 indicating that their alarms should be sounded. The detector 12 that detects the smoke becomes the master, with the other detectors being slave detectors. Upon receipt of the RF transmissions, the slave detectors 12 and the sound module(s) 14 will sound their alarms. The RF transmissions preferably continue for the duration of the alarm of the master detector. As discussed in more detail below, the RF transmissions preferably have a duration of less than about 100 ms.

When the button 38 or 66 is pressed during an alarm, the unit whose button was pressed sends out a silence message. The master detector desensitizes its sensor 30 and stops alarming if the detected smoke level is above the new level. The slave devices receive the silence message and expire their alarm timers and go back to standby mode.

A system test can also be initiated by the user from either one of the detectors 12 or from one of the sound modules 14 by pressing the button 38 or 66. If the detector 12 or sound module 14 is not in alarm when the button is pressed, the test message will be sent throughout the system. When the test/silence button 38 on a unit is pressed, or the device receives a test message, the device tests the circuitry in the alarm 32 and sensor 30. In the example shown herein, sensor 30 is an ion type smoke sensor. To test such an ion type sensor 30, the voltage to the sensor 30 is lowered and the measured voltage at the controller 20 drops in the same manner as when smoke is sensed. By using RF and transmitting a distinct test signal in the examples shown herein, not only is the communication path tested, but also each receiving device performs its own circuit test. For example, when a device receives a test signal, the device can perform all the normal test functions as if the test button on the device itself was pushed, such as lowering the voltage to the sensor 30 to simulate smoke and the produce an alarm signal from the successful completion of the self test.

For detectors 12 operating on DC power, during main operation (i.e. non-alarm operation), each detector 12 will enable its transceiver 22 at periodic intervals, for example 10 second intervals, to listen for a test or alarm message. This will reduce power consumption and allow the detectors 12 to operate on battery power for up to a year. When a detector goes into alarm, the transceiver 22 will enter a receive mode whenever the transceiver is not transmitting to listen for a silence message.

Message Description

Each message that is sent, for example alarm messages and manual message including the test and silence messages, can include the following exemplary components:

| ID | Command | Error Check |
|---|---|---|
| 1 Byte | 1 Byte | 1 Byte |

ID: A one-byte system wide identification number. The ID can be more than one-byte of desired.

Command: An instruction or message informing the receiving device what to do. The command can also be more than one byte if desired.

Error Check: A check in the message through which an error in the transmission can be determined and/or fixed. For example, the Error Check can be a checksum that is calculated by arithmetically adding the individual message bytes together. Another Error Check can be a cyclic redundancy check.

The message can be sent with the components ordered as in the above table. Alternatively, the message can be sent with the message components in other orders, the message can include multiple ones of each message component, and the message can comprise other combinations of message components. For example, two or more ID's can be provided, two or more commands can be provided, and two or more error checks can be provided.

The contents of the command component will vary depending on the purpose of the message as described below. Each command is sent most significant byte first.

Each time that a unit transmits, at least the system ID, command and an error check are sent. This allows the device receiving the message to respond differently based on the message received. The error check allows the integrity of the transmission to be verified, reducing the chance that random noise could cause an unwanted action to take place.

Message Types

A number of messages can be transmitted between the devices of the system 10. For example, the messages can include alarm messages resulting from detected hazardous conditions, manual messages that are sent at the request of a user, utility messages that are sent during production testing of the life safety devices, low battery messages, status messages, etc. The following are details on two exemplary types of messages.

Alarm Messages

| Description | Data | Comment |
|---|---|---|
| Smoke Detected | 0x82 | Causes receiving detectors and/or sound modules to enter Smoke alarm state |
| CO Detected | 0x83 | Causes receiving detectors and/or sound modules to enter CO alarm state |

Manual Messages

| Description | Data | Comment |
|---|---|---|
| Silence | 0x81 | Receiving detectors and sound modules that are in smoke alarm will cease to alarm. Initiating alarm will desensitize. |
| Test | 0x80 | Detectors and sound modules in standby/non-alarm mode will conduct a test. |

Message Coding

After the messages are composed by the controller, they are encoded using a suitable coding scheme. An example of a suitable coding scheme is Manchester Encoding where the messages are encoded into a series of edges with two edges representing a one and one edge representing a zero. An advantage of this encoding scheme is that the carrier is on for one half of the transmission and off for one half of the transmission. This allows for a more predictable power measurement. Also, since the transceiver is only on for one half the time, the peak power can be set higher, for example 3 dB higher.

Message Transmission

It is also advantageous to make the transmission time of a message as short as possible. This is because the Federal Communications Commission (FCC) averages output power over a 100 ms period. Thus, a transmission of less than 100 ms can have a higher power output than a transmission of 100 ms. For example, a transmission of 25 ms can have four times the power output of a transmission of 100 ms. This will result in greater range of each transmission. A shorter transmission time also allows a shorter transmission interval (given a constant duty cycle) so that receiving detectors and sound modules can enable their transceivers for a shorter period of time, thereby conserving battery power. The transmission can also have a period of about 125 ms.

In one embodiment, for a test or silence message transmission, a nominal transmission period of, for example, about 70 ms can be used. However, during an alarm message transmission, the transmission period is increased, for example to a nominal 100 ms. An advantage of this is that in an apartment building situation, where many smoke alarms may be transmitting on the same frequency (but with different ID's), there would be less of a chance of collision, thereby increasing the likelihood that master/initiating alarms will have their transmitted messages received. For test and silence messages, there is little chance that two adjacent apartments would be testing or silencing their alarms at the same time, so collision is not a great concern.

Figure 4:
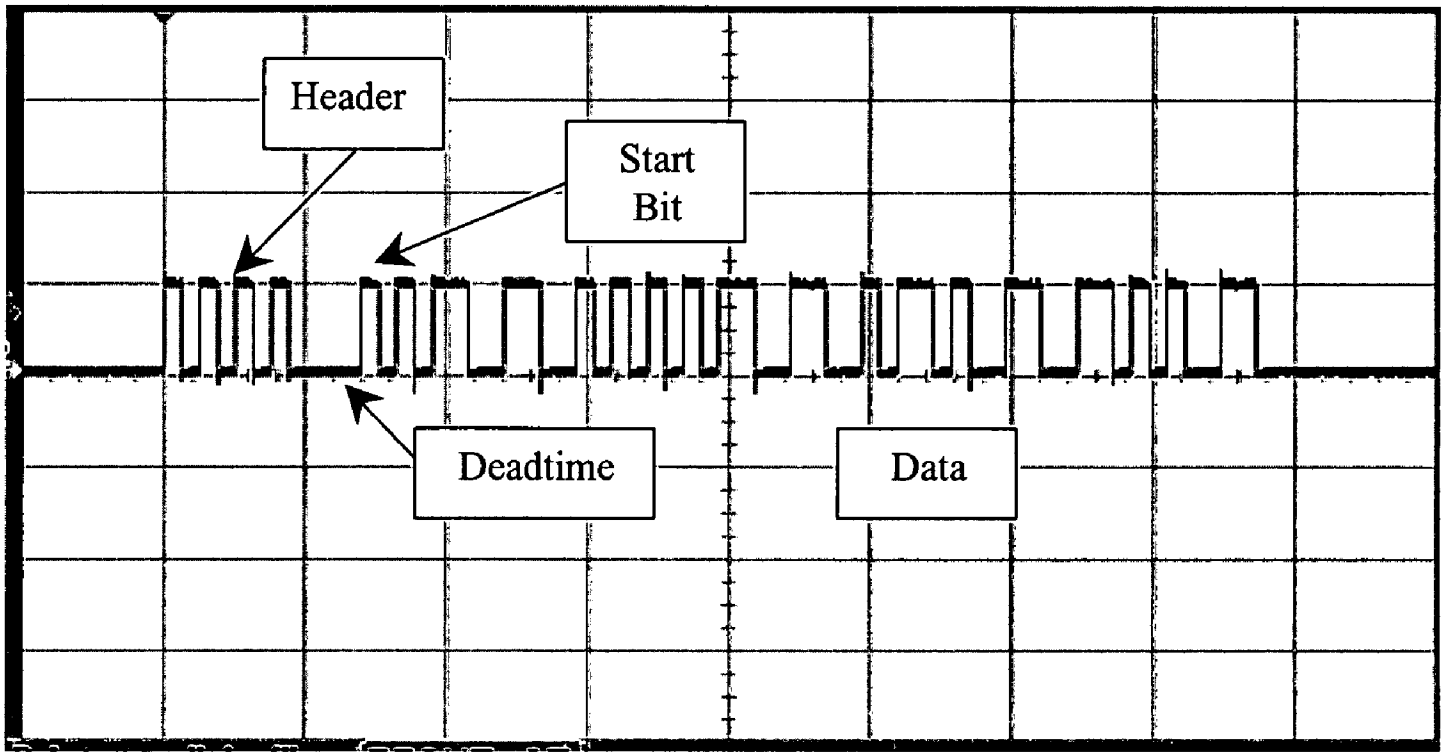
FIG. 4 illustrates the format of an RF transmission between the life safety devices.

The encoded bit stream is sent to the transceiver where it is modulated onto the RF carrier in an on/off keying (OOK) format, where the carrier is "on" to send a one, and the carrier is "off" to send a zero. The format of the RF transmission is shown in FIG. 4 and discussed below:

1. First a series of alternating ones and zeros is sent. This is the header.
2. The carrier is then turned off for a short period known as the deadtime.
3. A start bit is then sent.
4. The data is then sent.

In one alternative embodiment, the test message is transmitted with less power compared to the transmission power of alarm messages. For example, test messages can be transmitted with half the power used to transmit alarm messages. In this way, if a test message is successfully received by all of the devices in the system at the reduced power level, one can be assured that the critical alarm messages, which are transmitted at higher power, will be able to reach all of the devices in the system as well.

Collision Avoidance

If two or more devices of the system 10 transmit an RF message at the same time, the RF transceivers are unable to receive either message. In order to avoid this situation, a strategy needs to be employed to prevent such collisions. The following are exemplary collision avoidance strategies that can be employed.

Strategy 1

Before transmitting, a detector 12 or sound module 14 will turn on its transceiver to receive mode for a short period of time. If the transceiver receives a header, deadtime and start bit during the time that the transceiver is enabled in receive mode, then the detector or sound module will delay its own transmission until its current transmission is complete. This strategy is advantageous compared to simple carrier detect strategies by allowing a transmission in the presence of in-band interference.

However, if only a partial header has been received when the transceiver "on" time expires, the device will enable its transmission anyway. This will cause a collision with the transmitted data being lost.

Strategy 2

When a detector or sound module is enabled to broadcast an RF message, it has programmed within it a nominal interval time between each transmission. When the detector or sound module calculates the time of the next transmission, it adds an additional unpredictable time to the transmission interval. Thus, if two of the system devices transmit at the same time, the next transmission from each will most likely be at a different time allowing the collision avoidance mechanism above to come into play.

Power Conservation

One or more of the life safety devices of the system 10 is powered by direct current (DC), for example one or more batteries. To allow a life safety device to operate for an extended period of time (e.g., a year or more) on a single set of batteries, the transceiver of each detector and sound module(s) can be configured to be cycled on and off periodically. For example, the transceiver can be configured to turn on (i.e., wake up) once every 1, 2, 5, 10, 15, 30, or 60 seconds. In some embodiments, the transceiver remains on only long enough to perform certain operations such as, for example, receive a specified number of broadcast transmissions. For example, in one embodiment the transceiver remains in a wake state long enough to receive two broadcast messages before reentering the sleep mode.

If a detector 12 detects an alarm condition (e.g., a threshold level of smoke), or the transceiver receives an alarm message (or a test message) when awake, the transceiver of the detector remains in the wake state until the condition passes, at which time the transceiver enters the sleep cycle again.

System Operation

During main operation (i.e. when not in alarm state either as a result of detecting a hazardous condition or as a result of a test signal), a DC-powered device, for example a detector 12 operating on batteries, will only turn on its transceiver periodically to receive a message that may be being sent by other devices in the system 10. As the supply current is greater when the transceiver is on, this feature allows the detector 12 to operate longer on a set of batteries. An AC-powered device operating on battery backup will operate in the same way for the same reason. In addition, the controller of each DC-powered device is turned on and off periodically, for example every 18 ms, which conserves additional power.

When a DC-powered device receives an alarm message it turns its transceiver on continuously to a receive mode, starts a 10 second timer and produces an audible alarm until the timer is canceled or expires. Each time the device receives an alarm message, the timer is reset extending the alarm signal for ten seconds from that time. This is beneficial in preventing the alarm from going in and out of alarm from interference or bad reception.

When a device receives a test message, the device performs a self-test but maintains the once per ten seconds transceiver cycle. The device also only produces two audible, temporal patterns associated with a test message and not an alarm that would be produced upon detection of smoke. This ensures the consumer that the device is performing the same functions it would if the test/silence button was pushed and conserves on battery capacity.

When a device receives an alarm message and has started alarming, it turns its transceiver on continuously in a receive mode and listens for additional alarm messages or silence messages. If the silence message is received, the device expires it alarm timer, stops alarming and returns to standby. This silences the alarms of the system more quickly than waiting for the alarm timer to expire. When a master detector receives the silence message, it also puts the detector into silence mode, and desensitizes its alarm circuitry.

Figure 5A:
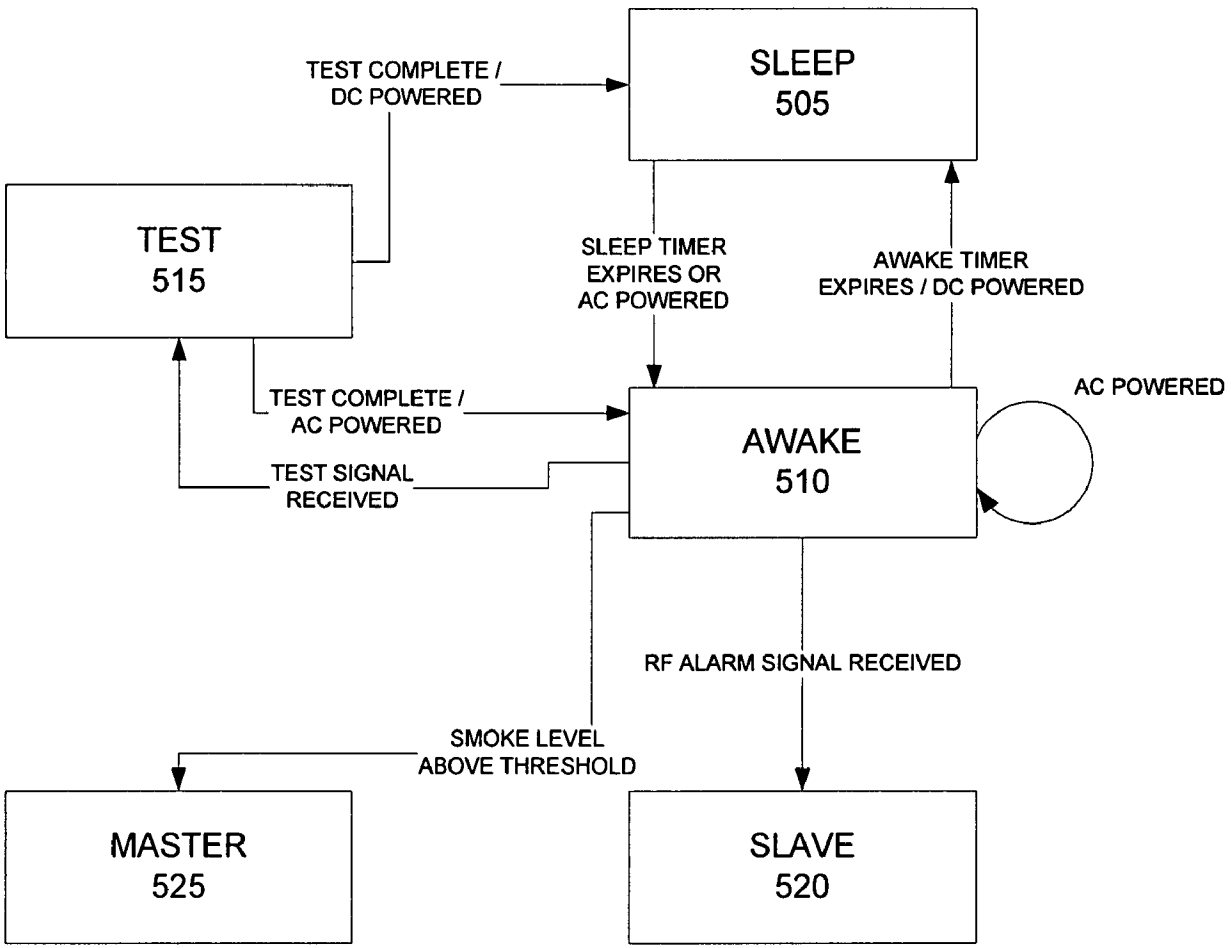
FIGS. 5A, 5B and 5C are flow charts illustrating exemplary operation of hazardous condition detectors of the system.
Figure 5B:
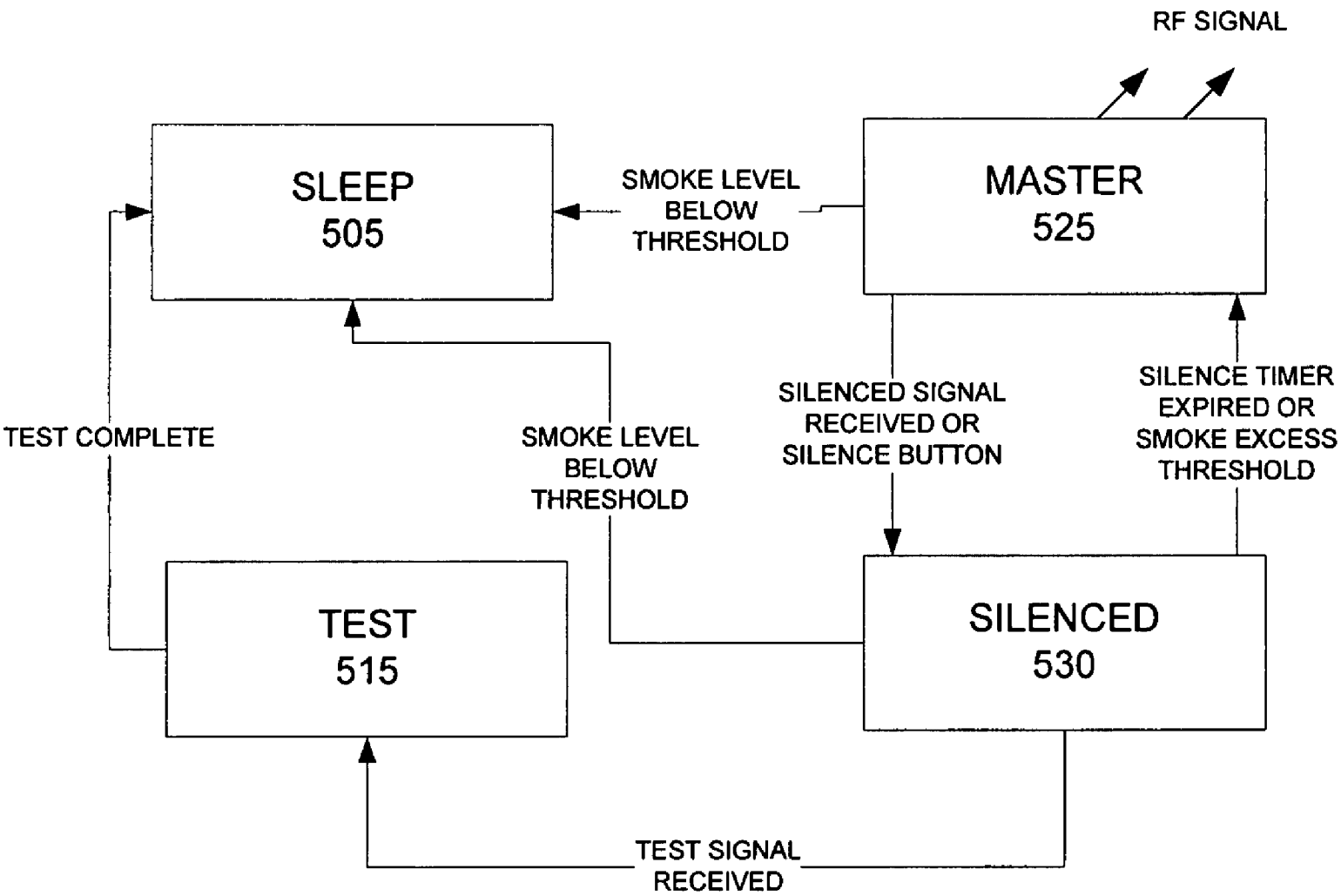
Figure 5C:
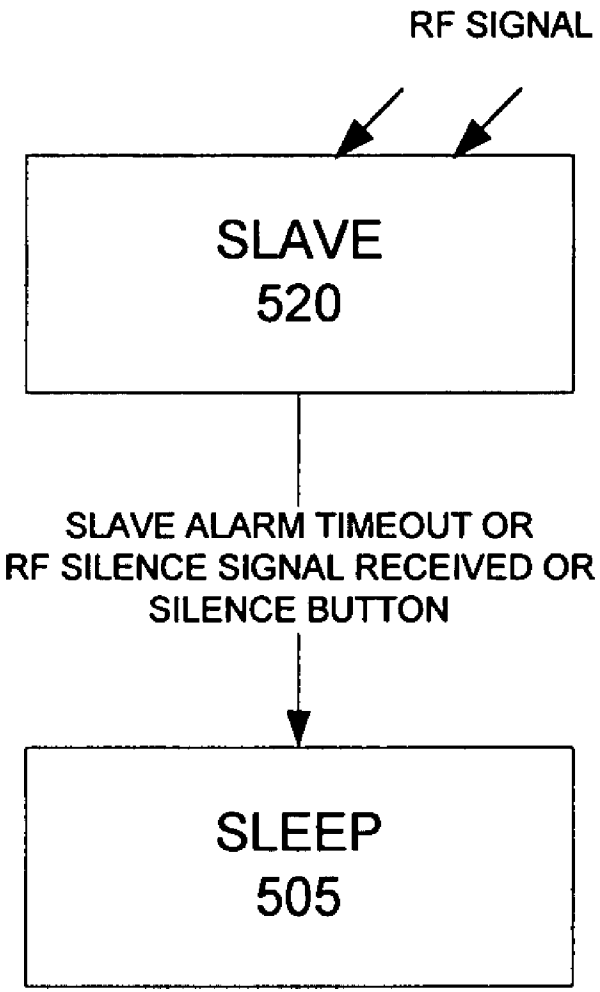

FIGS. 5A, 5B, and 5C illustrate operation of example life safety devices, such as smoke detectors 12 within the system 10. A similar operation would apply for a sound module 14 except the sound module 14 does not have smoke detection capability.

Referring initially to FIG. 5A, in main mode, the controller of each detector powered by a battery has a sleep mode 505 for a period of time determined by a sleep timer. In the sleep mode 505, the transceiver 22 is turned off and is unable to receive or transmit RF messages. Upon expiration of the sleep timer, the controller enters an awake mode 510 for a period of time determined by an awake timer. During this time, the receiver portion of the transceiver 22 can be turned on to listen for an RF signal, if the transceiver sleep timer also expires. For example, the controller can awaken every 18 ms while the transceiver awakens every 10 seconds. Both the sleep timer and awake timer functions are performed by firmware in the controller 20.

If the transceiver is in a sleep mode when the controller comes out of sleep mode and remains in sleep mode while the controller is in awake mode, the controller will return to sleep mode upon expiration of the awake timer. When the transceiver is in an awake mode at the same time the controller is in the awake mode 510, the receiver portion of the transceiver 22 listens for RF signals from other devices in the system. The controller remains in the awake mode when the receiver portion of the transceiver is on listening for RF signals. If no RF signal is received and the awake timer of the transceiver expires, the controller returns to the sleep mode 505.

In example embodiments of AC powered detectors, the detectors remain in awake mode 510 rather than sleep mode 505.

If the transceiver 22 of a detector receives a test signal in the awake mode 510, that detector enters a test mode 515 for testing the operation of the detector. Once the test is complete, the controller returns to the sleep mode 505 if battery powered, or awake mode 510 if AC powered. If the transceiver 22 of a detector receives an RF alarm signal in the awake mode 510, that detector then becomes a slave detector 520 and starts alarming to warn of the detected smoke. The slave 520 also turns its transceiver on continuously to listen for additional alarm messages or silence messages sent by another device in the system.

If in the awake mode 510 the sensor senses a smoke level above an alarm threshold, the detector becomes a master detector 525 (unless the detector is already a slave), sounds its alarm 32 and starts alternately sending RF alarm signals to other detectors 12 and devices in the system, and listening for RF signals from other devices. Those RF alarm signals that are sent by the master 525 and that are received by other detectors that are in the awake mode 510 turn those detectors into slave detectors 520.

FIG. 5B illustrates the operation of the master detector 525 that has detected a smoke level that is above the alarm threshold. As shown in FIG. 5B, if the smoke level detected by the sensor 30 of the master detector 525 thereafter is below the threshold, the alarm 32 of the master 525 is silenced and its controller re-enters the sleep mode 505. Another possibility is for the master 525 to receive a silence signal, either via RF from another device in the system or by the user pushing the button 38 on the master 525. If the master 525 receives a silence signal or is desensitized by the user pressing silence button 42, the master 525 enters a silenced mode 530 governed by a silence timer built into the controller 20. From the silenced mode 530, if the smoke level detected by the sensor 30 is below the threshold, the controller of the master 525 returns to the sleep mode 505. On the other hand, if the silence timer expires or the smoke level detected by the sensor 30 is above the threshold, the master 525 exits the silenced mode 530 and returns back sounding its alarm and transmitting RF alarm signals.

In addition, if the master 525 receives a test signal while in the silenced mode 530, the master 525 enters the test mode 515 for testing the operation of the master 525. The test signal could come from receipt of an RF test signal or by the user again pushing the button 38 on the master after pushing the button to enter the silenced mode 530. After the test is complete, the controller of the master 525 will return to the sleep mode 505.

FIG. 5C illustrates operation of a slave detector 520 that has entered an alarm state upon receiving an RF alarm signal from the master 525. The slave 520 remains in an alarm condition for a period of time controlled by the controller 20. At the expiration of the period of time, upon receipt of an RF silence signal from a detector or other device in the system, or upon receipt of a silence signal resulting from pushing the button 38 on the slave 520, the controller of the slave 520 returns to the sleep mode 505.

In the sleep mode, the controller 20 of the detector 12 wakes up (i.e. enters awake mode) periodically, for example every 18 ms, to perform detection functions (e.g., measure smoke density) and take care of other tasks, for example checking the battery level and checking whether the test/silence button has been pressed. However, when an alarm condition is sensed (or the detector receives an alarm message or test message), the processor wakes up and remains in the awake mode until the condition is not sensed, whereupon it returns to the sleep mode.

As discussed above, the audible alarm can include a suitable voice message. The voice message can indicate the type of sensed condition, the location of the sensed condition, and/or a brief instruction announcing what should be done as a result of the sensed condition. However, the detectors and/or sound module can play additional voice messages unrelated to an alarm event or a test. For example, a voice message can announce when a device has entered the silenced mode 530, when a device exits the silenced mode 530, when a low battery has been detected. In addition, a voice message can be played upon installing a device instructing the user to push the test/silence button to trigger a test of the system, or congratulating the user on purchasing the device. During a fire condition, it is preferred that a voice message announcing the fire (or a voice message announcing any other detected hazardous condition) be played at a louder level than non-alarm messages so that the user's attention is drawn to the hazardous condition.

The above-described RF system 10 can be integrated with a gateway system of the type described in U.S. Patent Provisional Application Ser. No. 60/620,226 filed on Oct. 18, 2004. As described in that application, a gateway device is hardwired to existing detectors and is used to communicate wirelessly with one or more RF-capable detectors, thereby allowing existing, hardwired detectors to work with later added RF detectors to form an alarm system. In such a system, if the detector that initiates the alarm is a hardwired alarm or the gateway device, and that detector receives a silence message, it will deactivate the hardwire interconnect line, thereby silencing the hardwired portion of the alarm system. An example of a hardwired alarm system is disclosed in U.S. Pat. No. 6,791,453.

What is claimed is:

1. A method of radio frequency communication for a life safety device including a controller, a hazardous condition sensor, an alarm device, and a radio frequency communications device including transmitting and receiving capability, the method comprising:

receiving a test signal using the radio frequency communications device, wherein the test signal is at a first duration that is shorter than an alarm signal at a second duration;

lowering a voltage to the hazardous condition sensor to simulate a hazardous condition to test the hazardous condition sensor; and emitting an alarm using the alarm device if the hazardous condition sensor passes the test.

2. The method of claim 1, further comprising:

receiving a silence signal using the radio frequency communications device;

if the device is a master, desensitizing the hazardous condition sensor; and stopping the alarm from the alarm device.

3. The method of claim 1, further comprising:

before transmitting a radio frequency signal, turning on the radio frequency communications device for a period of time; and delaying transmission if the radio frequency communications device receives a header, deadtime and startbit.

4. The method of claim 3, further comprising:

calculating a time of a next transmission; and adding an unpredictable time to the time of the next transmission.

5. The method of claim 1, wherein receiving further comprises receiving the test signal at approximately one-half of a transmission power of an alarm signal.

6. A method of radio frequency communication for a life safety device including a controller, a hazardous condition sensor, an alarm, and a radio frequency communications device including transmitting and receiving capability, the method comprising:

before transmitting a radio frequency signal, turning on the radio frequency communications device for a period of time; and delaying transmission if the radio frequency communications device receives a header, deadtime and startbit.

7. The method of claim 6, further comprising:

calculating a time of a next transmission; and adding an unpredictable time to the time of the next transmission.

8. The method of claim 6, further comprising:

sending a test or silence signal of a first duration; and sending an alarm signal at a second duration greater than the first duration.

9. A method of radio frequency communication for a life safety device including a controller, a hazardous condition sensor, an alarm, and a radio frequency communications device including transmitting and receiving capability, the method comprising:

sending a test signal at a first transmission power level; and sending an alarm signal at a second transmission power level greater than the first transmission power level.

10. The method of claim 9, wherein the first transmission power is approximately one-half of the second transmission power.

11. The method of claim 9, further comprising:

receiving a second test signal using the radio frequency communications device;

lowering a voltage to the hazardous condition sensor to simulate a hazardous condition to test the hazardous condition sensor; and emitting an alarm using the alarm device if the hazardous condition sensor passes the test.

12. The method of claim 9, further comprising:

receiving a silence signal using the radio frequency communications device;

if the device is a master, desensitizing the hazardous condition sensor; and stopping an alarm from the alarm device.

13. The method of claim 9, further comprising:

sending the test signal at a first duration; and sending an alarm signal at a second duration greater than the first duration.

* * * * *